US006734359B2

(12) United States Patent
Hanazaki et al.

(10) Patent No.: US 6,734,359 B2
(45) Date of Patent: May 11, 2004

(54) WIRE CONNECTING STRUCTURE AND CONNECTING METHOD

(75) Inventors: Hisashi Hanazaki, Shizuoka (JP); Takashi Ishii, Shizuoka (JP); Toshihiro Maki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/050,568

(22) Filed: Jan. 18, 2002

(65) Prior Publication Data

US 2002/0096353 A1 Jul. 25, 2002

(30) Foreign Application Priority Data

Jan. 19, 2001 (JP) ..... P2001-012053

(51) Int. Cl.[7] ..... H01R 4/20
(52) U.S. Cl. ..... 174/84 C; 439/877
(58) Field of Search ..... 174/74 R, 75 C, 174/84 C; 439/877, 880, 882

(56) References Cited

U.S. PATENT DOCUMENTS

| | | | | |
|---|---|---|---|---|
| 1,827,297 A | | 10/1931 | Moore | |
| 2,526,277 A | | 10/1950 | Rogoff | |
| 2,674,647 A | * | 4/1954 | Dibner | 174/74 A |
| 3,281,524 A | * | 10/1966 | Lynch, Jr. et al. | 174/84 C |
| 3,739,470 A | * | 6/1973 | Eppler | 174/84 C |
| 3,934,333 A | * | 1/1976 | Churchill | 219/523 |
| 4,959,508 A | * | 9/1990 | McGrane | 174/84 C |
| 5,422,438 A | | 6/1995 | Lamome | |
| 5,496,968 A | | 3/1996 | Katoh et al. | |
| 5,504,275 A | * | 4/1996 | Scramoncin | 174/84 C |
| 5,620,338 A | | 4/1997 | Stephens et al. | |
| 5,824,998 A | * | 10/1998 | Livshiz et al. | 219/617 |
| 6,261,137 B1 | * | 7/2001 | Wilcox | 174/84 C |

FOREIGN PATENT DOCUMENTS

| | | |
|---|---|---|
| EP | 0 138 700 | 4/1985 |
| FR | 2 683 396 A1 | 5/1993 |
| GB | 815044 | 6/1959 |
| GB | 1 232 230 | 5/1971 |
| JP | 49-485 | 5/1947 |
| JP | 63-178068 | 11/1988 |
| JP | 11-224700 | 8/1999 |

OTHER PUBLICATIONS

Japanese abstract, 63–178068, Nov. 17, 1988.

* cited by examiner

*Primary Examiner*—Chau N. Nguyen
(74) *Attorney, Agent, or Firm*—Sughrue Mion, PLLC

(57) ABSTRACT

Conductor portions (11) of a total of two or more wires (2) are compressively pressed uniformly over an entire periphery within one or a plurality of tubular portions (13) of a terminal (19, and are connected thereto. The terminal (1) has the pair of tubular portions (13) formed respectively at opposite sides thereof, and the conductor portions (11) of one or more wires (2) are compressively pressed uniformly over the entire periphery within each of the tubular portions, and are connected thereto. Alternatively, the terminal has one tubular portion, and the conductor portions (11) of the plurality of wires (2) are compressively pressed uniformly over the entire periphery within the tubular portion in such a manner that the conductor portions are combined together. Conductor portions (11) of a total of two or more wires (2) are inserted into one or a plurality of tubular portions (13) of a terminal (1), and the tubular portion is compressively pressed uniformly over an entire periphery thereof. The compressive pressing of the tubular portion (13) is effected by a rotary swaging machine.

5 Claims, 7 Drawing Sheets

WIRE CONNECTING STRUCTURE AND CONNECTING METHOD

BACKGROUND OF THE INVENTION

This invention relates to a wire connecting structure and a wire connecting method, in which a plurality of wires are jointly connected to a terminal by rotary swaging or the like.

FIGS. 7 and 8 show one form of wire connecting structure and method (see JP-49-485U)

In this connecting structure and method, conductor portions (wire conductor portions) 33 of two wires 32 and 32 are pressed (clamped) to be connected together, using a joint terminal 31.

The joint terminal 31 is formed by blanking a piece from a single electrically-conductive metal sheet and then by curving it into a curl shape, and a pair of right and left circumferentially-extending notches 34 are formed in a longitudinally-intermediate portion thereof to thereby form a pair of right and left curved press-fastening piece portions (press-clamping piece portions) 35 and 35 at each of front and rear portions of the terminal. As another form of joint terminal 31, there may be used one including a base plate portion (not shown) of a generally flat plate-like shape, and two pairs of press-fastening piece portions (not shown), each pair of press-fastening piece portions extending upwardly from opposite (right and left) side edges of the base plate portion, respectively.

As shown in FIG. 7, the two front and rear wires 32 and 32 are inserted and set in the joint terminal 31, and for example, by the use of a terminal clamping machine (not shown), each press-clamping piece portion 35 is pressed between an upper crimper (upper die) and a lower anvil (lower die) to be formed into a curl shape, thereby connecting the conductor portions 33 and 33 of the two wires 32 and 32 together.

Usually, the wire 32 is inserted into the joint terminal 31 through an opening between the right and left press-fastening piece portions 35 and 35. An insulating sheath 36 of each wire 32 is fixed, for example, by a clip, provided on the wire clamping machine, thereby holding each wire 32 against displacement in the forward and rearward directions, and in this condition the above press-fastening operation is effected. The pair of front press-fastening piece portions 35 and the pair of rear press-fastening piece portions 35 are press-deformed respectively by the separate crimper (upper die)-anvil (lower die) structures (Even if the two are integral with each other, they are spaced from each other in the longitudinal direction of the terminal), or after the pair of front press-clamping piece portions 35 are press-deformed, the pair of rear press-clamping piece portions 35 are press-deformed, so that bell mouths (bulge portions) 37 are formed respectively at the front and rear ends of each press-fastening piece portion 35 as shown in FIG. 8.

The number of the wires 32 is not limited to two, but may be three or more, and there can be provided a joint or branch connection in which for example, one wire extends forwardly from the joint terminal 31 while two wires extend rearwardly from the joint terminal. The branch connection is a kind of joint connection, and is one form of connection by which, for example, a power source is distributed from one power source wire to a plurality of branch wires.

Using the type of joint terminal which is provided not with two (front and rear) pairs of press-fastening piece portions (press-clamping piece portions) but with a pair of right and left press-fastening piece portions, two wires 32 and 32 can be set in the terminal not from front and rear directions (different directions) but from the same direction, and can be arranged in parallel relation. In this case, also, three or more wires 32 can be press-fastened at the same time.

In the above conventional wire connecting structure and method, however, the conductor portions 33 and 33 of the two wires 32 and 32, pressed to be connected together by the joint terminal 31, are liable to be separated right and left from each other as shown in FIG. 9, and in this case a gap 38 is formed between the two conductor portions 33 and 33, and this often deteriorated the contact ability. Particularly when the pair of right and left press-clamping piece portions or each pair of press-clamping piece portions are press-deformed into a curl shape by the crimper (upper die) and anvil (lower die) of the press-clamping machine as shown in FIG. 9, press-fastening forces, exerted in the upward and downward directions (directions of arrows H), tend to be large while press-fastening forces, exerted in the right and left directions (directions of arrow I), tend to be small, and therefore there has been encountered a problem that gaps are liable to develop between the right and left conductor portions 33 and 33 and between the outer surface of each of the right and left conductor portions 33 and 33 and the inner surface of a right (left) portion of each press-clamping piece portion 35.

Depending on the pressing conditions and so on of the clamping machine, gaps developed between element wires of the conductor portion 33 (One conductor portion is formed by a plurality of element wires), and also gaps developed between the inner surface of the joint terminal 31 and the element wires, which deteriorated the contacting ability. Particularly when three or more wires 32 were used, or thick wires 32 for a power source or the like were used, so that the total number of element wires increased, there was encountered a problem that such gaps were liable to develop. When gaps thus developed between the conductor portions 33 and between the element wires, there was encountered a problem that not only the electrical contact performance was deteriorated, but also the connecting portion, including the joint terminal 31, and its neighboring portion were heated to be adversely affected.

When an aluminum material was used for the joint terminal 31 and/or the conductor portion 33 of each wire 32, an oxide film was liable to deposit on the inner surface of the joint terminal 31 and/or the surface of each conductor portion 33 with the lapse of time, and particularly when gaps existed between the joint terminal 31 and the conductor portion 33 and between the element wires of the conductor portion 33, an oxide film was liable to deposit on such gap portions, which invited a problem that the conducting resistance increased, so that the conducting ability was deteriorated.

On the other hand, there are known a structure and a method in which instead of the joint terminal of the above form, there is used a joint terminal (particularly for use with a large current), having a tubular portion (not shown), and conductor portions 33 of wires 32 are inserted into the tubular portion, and the tubular portion is compressively pressed at four to six points on its outer peripheral surface, and is connected to the conductor portions 33. In this case, there was been encountered a problem that stresses concentrated on the four to six pressed portions of the tubular portion, and the contact of the remaining portions with the conductor portion 33, as well as the intimate contact within the conductor portion 33, were liable to be deteriorated.

SUMMARY OF THE INVENTION

With the problems of the above forms in view, it is an object of this invention to provide a wire connecting structure and a wire connecting method, in which in the joint connection of wires, including a branch connection, any gap will not develop between a terminal and each conductor portion, between the conductor portions and between elements wires, forming each conductor portion, thereby enhancing the reliability of the electrical connection, and besides even when there are used those terminal and conductor portions which are made of an aluminum material, the good electrical connection can be obtained.

In order to achieve the above object, the present invention provides a wire connecting structure characterized in that conductor portions of a total of two or more wires are compressively pressed uniformly over an entire periphery within one or a plurality of tubular portions of a terminal, and are connected thereto.

Effectively, the terminal has a pair of tubular portions formed respectively at opposite sides thereof, and the conductor portions of one or more wires are compressively pressed uniformly over the entire periphery within each of the tubular portions, and are connected thereto.

Effectively, in the wire connecting structure, the terminal has one tubular portion, and the conductor portions of the plurality of wires are compressively pressed uniformly over the entire periphery within the tubular portion in such a manner that the conductor portions are combined together.

In order to achieve the above object, the invention also provides a wire connecting method characterized in that conductor portions of a total of two or more wires are inserted into one or a plurality of tubular portions of a terminal, and the tubular portion is compressively pressed uniformly over an entire periphery thereof.

In the wire connecting method, effectively, the compressive pressing of the tubular portion is effected by a rotary swaging machine.

BRIEF DESCRIPTION OF THE DRAWINGS

FIG. 1 shows a wire connecting structure and a wire connecting method provided in accordance with a first embodiment of the invention.

FIG. 3 shows a wire-connected condition in the first embodiment.

FIG. 5 shows a wire connecting structure and a wire connecting method provided in accordance with a second embodiment of the invention.

FIG. 6 shows a wire-connected condition in the second embodiment.

DETAILED DESCRIPTION OF PREFERRED EMBODIMENTS

A preferred embodiment of the present invention will now be described in detail with reference to the drawings.

FIGS. 1 to 4 show a wire connecting structure and a wire connecting method provided in accordance with a first embodiment of the invention.

Figure 1A:
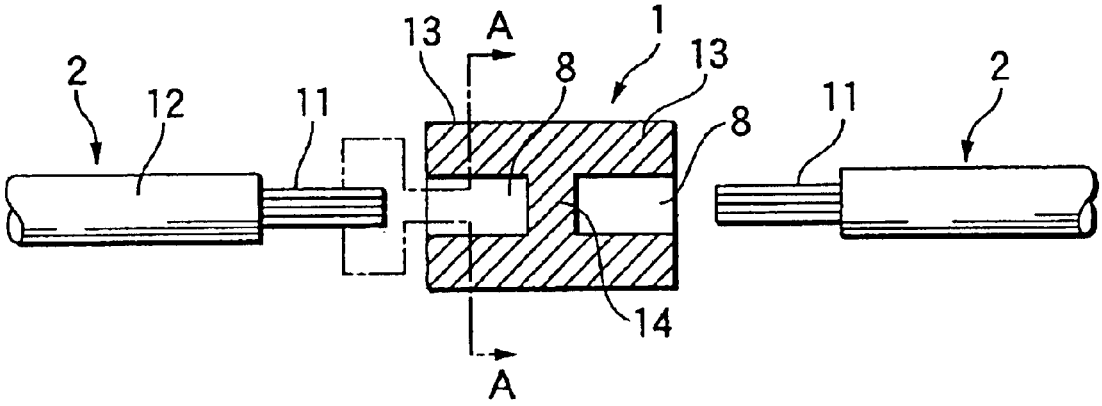
FIG. 1A is a partly (terminal) cross-sectional, plan view.
Figure 1B:
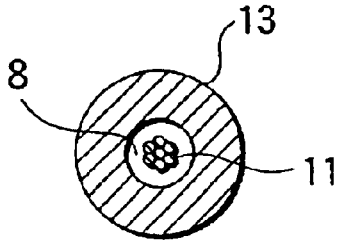
FIG. 1B is a cross-sectional view taken along the line A—A.
Figure 2:
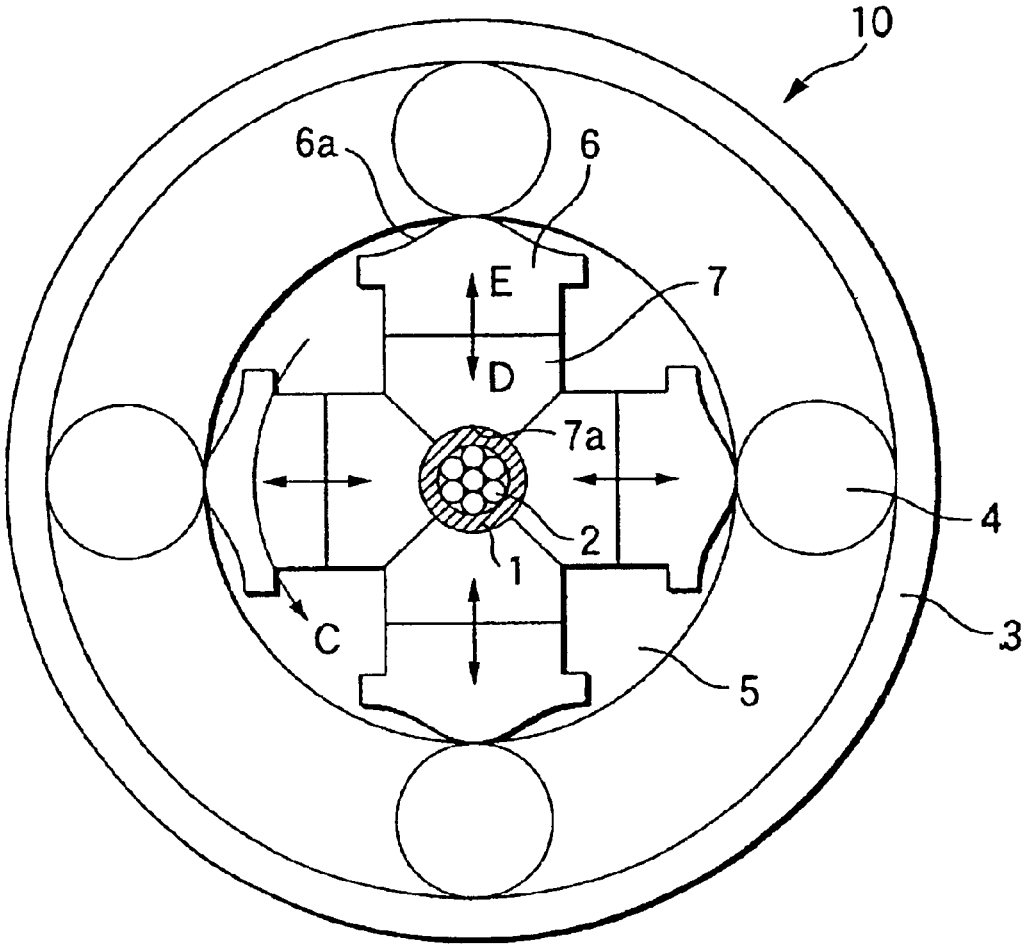
FIG. 2 is a front-elevational view showing one form of a working portion of a rotary swaging machine.

This connecting structure and method are characterized in that there is used a generally-cylindrical joint terminal (terminal) 1 having wire insertion holes 8 and 8 formed respectively in front and rear ends thereof, as shown in FIG. 1, and conductor portions 11 and 11 of wires 2 and 2 are inserted into the holes 8 from the front and rear sides, respectively, and in this condition front and rear tubular portions 13 and 13 of the joint terminal 1, are pressed to be compressively deformed (plastically deformed) uniformly over their entire periphery, using, for example, a rotary swaging machine 10 shown in FIG. 2.

Using a copper alloy or an aluminum material such as aluminum and an aluminum alloy, the joint terminal 1 is formed in such a manner that its outer peripheral surface has the uniform diameter over an entire length thereof as shown in FIG. 1A. The circular holes 8 and 8 are formed respectively in the front and rear ends in concentric relation to this outer peripheral surface as shown in FIG. 1B, and a partition wall 14 is formed between the bottom surfaces of the holes 8. The inner diameter of each hole 8 is larger than the outer diameter of the conductor portion 11 of the wire 2 so that the conductor portion 11 can be easily inserted into the hole 8. The depth of each hole 8 is equal to or larger than the length of the exposed portion of the conductor portion 11. In this embodiment, the wall thickness of the central partition wall 14 is larger than the wall thickness of the peripheral wall of each tubular portion 13. The wall thickness of each tubular portion 13 is suitably determined in accordance with the outer diameter of the wire 2. The wall thickness of the tubular portions 13, shown in FIGS. 1 to 4, is shown merely for description purposes, and actually this wall thickness maybe smaller than the illustrated wall thickness.

Each wire 2 is an insulating sheathed wire, and each conductor portion 11 is composed of a plurality of element wires made of a copper alloy or an aluminum material. The conductor portion 11 is formed by the element wires which may be twisted together or may extend straight without being twisted. An insulating sheath 12 is made of a soft insulative resin material such as vinyl, and each wire 2 can be easily flexed or bent. The conductor portion 11 is exposed by removing the insulating sheath 12 over a predetermined length from the wire end portion. In the peeling operation, a slit is formed in the outer peripheral surface of the insulating sheath 12 by a cutter such as an automatic peeling machine (not shown), and then the wire is, for example, pulled.

In the case where the conductor portions 11 of the wires 2 have the same outer diameter, the front and rear tubular portions 13 of the joint terminal 1 have the same outer diameter, and the holes 8 have the same inner diameter. Even if the front and rear conductor portions 11 are slightly different in outer diameter from each other, the tubular portions 13, having the same inner and outer diameters, can easily deal with this situation by compressively deforming these tubular portions 13 by the rotary swaging machine 10 (described later) in so far as the conductor portions 11 can be inserted respectively into the tubular portions 13. In the case where the outer diameters of the conductor portions 11 are much different from each other, this can be easily dealt with by changing the amount of compressive deformation (by exchanging dies 7 described later). When it is desired to deal with this situation without exchanging the dies 7, the outer diameters of the tubular portions 13 and the inner diameters of the holes 8 are determined in accordance with the diameters of the conductor portions 11, so that the outer peripheral surfaces of the front and rear tubular portions 13 and 13 can have different diameters. Alternatively, only the inner diameter of the hole 8 can be changed while the tubular portions 13 have the same outer diameter.

In FIG. 1, the conductor portions 11 of the wires 2 are inserted respectively in the front and rear tubular portions 13 of the joint terminal 1, and in this condition the tubular portions 13 are compressively pressed sequentially (the front tubular portion is first pressed, and then the rear tubular portion is pressed) or simultaneously uniformly over their entire periphery, for example, by a working portion (main portion excluding a motor and so on) of the rotary swaging machine 10 shown in FIG. 2. The term "pressed uniformly over the entire periphery" means that the outer peripheral surface of the tubular portion 13 is all pressed uniformly over the entire periphery thereof. As a result, the conductor portion 11 of each wire 2 is compressed uniformly over the entire periphery thereof within the tubular portion 13, and is connected to this tubular portion 13. The exposed portion (shown in FIG. 1) of the conductor portion 11 of each wire 2 is compressed generally over the entire length thereof.

In the rotary swaging machine 10, the tubular portion 13 (FIG. 1) of the joint terminal 1 is gradually compressed and plastically deformed radially by the plurality of dies 7 revolving in the direction of the periphery of the wire 2. FIG. 2 shows one example in which one form of rotary swaging machine 10 is used as one example of entire-periphery pressing machines.

Swaging processing (swaging) has long been used as one form in the metal plastic working field, and in old days, a workpiece was hammered to be plastically worked by a hammer, and in view of a working efficiency, a working precision, an operation efficiency, safety and so on, the operation for hammering the workpiece by the hammer is rationalized mechanically and physically.

In FIG. 2, reference numeral 1 denotes the joint terminal (more accurately, the cylindrical portion 13 of the joint terminal 1), reference numeral 2 the wire (more accurately, the conductor portion 11 of the wire 2), reference numeral 3 an outer ring made of metal, reference numeral 5 a spindle of metal, reference numeral 6 a hammer of metal, reference numeral 7 the die of metal, reference numeral 4 a guide roller of metal.

The spindle 5 is driven to be rotated by a motor (not shown). The inner dies 7 are integrally connected to the outer hammers 6, respectively, and these pairs are arranged at intervals of 90 degrees, and can slidingly move back and forth radially of the wire 2 as indicated by arrows D and E. The guide rollers 4 are held in contact with an inner peripheral surface of the outer ring 3, and mountain-like cam surfaces 6*a* of the hammers 6 contact inner surfaces of the guide rollers 4. Each of the guide rollers 4 is supported on a body of the working portion so as to rotate about its axis. Each of the dies 7 has an inner peripheral surface 7*a* of an arcuate shape.

When the spindle 5 is rotated by the motor (not shown), the dies 7 and the hammers 6 are rotated in unison, and the cam surface 6*a* of each hammer 6 is in sliding contact with the outer peripheral surface of the roller 4, and when the apex of each cam surface 6*a* is brought into contact with the roller 4, the dies 7 are closed in the directions of arrows D, and then a foot portion of each cam surface 6*a* is brought into sliding contact with the roller 4, and the hammers 6 and the dies 7 are slidingly moved outwardly as indicated by arrows E under the influence of a centrifugal force, so that the dies 7 are opened. Thus, the plurality of dies 7, while rotating, are opened and closed.

When the dies 7 are closed, the tubular portion 13 (FIG. 1) of the joint terminal 1 is pounded by the inner peripheral surfaces 7*a* of the dies 7, and is compressed radially. When the dies 7 are opened, a gap is formed between the inner peripheral surface 7*a* of each die 7 and the tubular portion 13 of the joint terminal 1. The dies 7, while rotating, are thus repeatedly opened and closed, and by doing so, the tubular portion 13 of the joint terminal 1 is pressed with a uniform force over the entire periphery thereof into a precisely-circular shape as shown in FIG. 3, and the conductor portion 11 of the wire 2 is brought into intimate contact with the inner peripheral surface of the tubular portion 13, that is, the inner surface of the hole 8 (FIG. 1), with no gap formed therebetween, and at the same time the element wires of the conductor portion 11 are intimately contacted with one another, with no gap formed therebetween.

The number of the dies 7 may be two (In this case, the dies 7 are arranged at an interval of 180 degrees, and each die 7 has a semi-circular inner peripheral surface). The number of the rollers 4 does not need to be four, and eight rollers may be arranged at equal intervals.

Figure 3A:
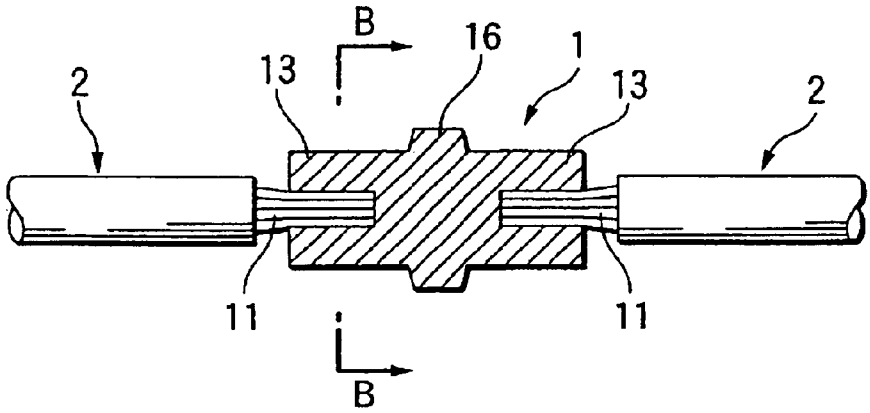
FIG. 3A is a partly-cross-sectional, plan view.
Figure 3B:
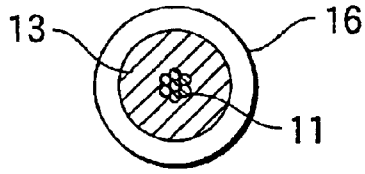
FIG. 3B is a cross-sectional view taken along the line B—B.

By the above rotary swaging, each tubular portion 13 is reduced in diameter as shown in FIG. 3A, and is extended in its longitudinal direction. Each conductor portion 11 is compressed radially by the tubular portion 13, that is, compressed with a uniform force over the entire periphery thereof, and the outer peripheral surface of the conductor portion 11 is pressed against the inner peripheral surface of the hole 8 (FIG. 1) in the tubular portion 13 with the strong force, and is held in intimate contact therewith, with no gap formed therebetween. Those element wires of each conductor portion 11, disposed at the outer peripheral portion thereof, bite into the inner peripheral surface of the tubular portion 13, and therefore are held in intimate contact therewith, with no gap formed therebetween. As a result, there exists no gap between each conductor portion 11 and the corresponding tubular portion 13. The element wires are pressed in the diameter-reducing direction with the strong force, and are deformed to assume, for example, a honeycomb-like cross-sectional shape, and are intimately contacted with one another, with no gap formed therebetween.

Thus, a gap between each conductor portion 11 and the joint terminal 1, as well as gaps between the element wires, is completely eliminated, so that the electrical contact performance is markedly enhanced. Namely, an electrical resistance between each conductor portion 11 and the joint terminal 1 is reduced, so that the conducting performance is enhanced, and besides the heating of the joint connecting portion, including the joint terminal 1, is prevented. As a result, the front and rear wires 2 are connected together without a conducting loss.

For example, even in the case where an aluminum material is used for the joint terminal 1 and/or the conductor portion 11 of each wire 2, an oxide film will not deposit on these since a gap does not develop between each tubular portion 13 of the joint terminal 1 and the conductor portion 11 of the wire 2, and also a gap does not develop between the element wires of the conductor portion 11. Even if the deposition of such oxide film initially occurs, the oxide film, formed on the inner surface of the tubular portion 13 and/or the surface of the conductor portion 11, is removed when those element wires of the conductor portion 11, disposed at the outer peripheral portion thereof, bite into the inner peripheral surface of the tubular portion 13, and as a result the base material of the conductor portion 11 directly contacts the base material of the tubular portion 13. Therefore, the conducting resistance between the joint terminal 1 and the conductor portion 11 of each wire 2 is reduced, so that the electrical connection reliability is enhanced as described above.

Figure 10:
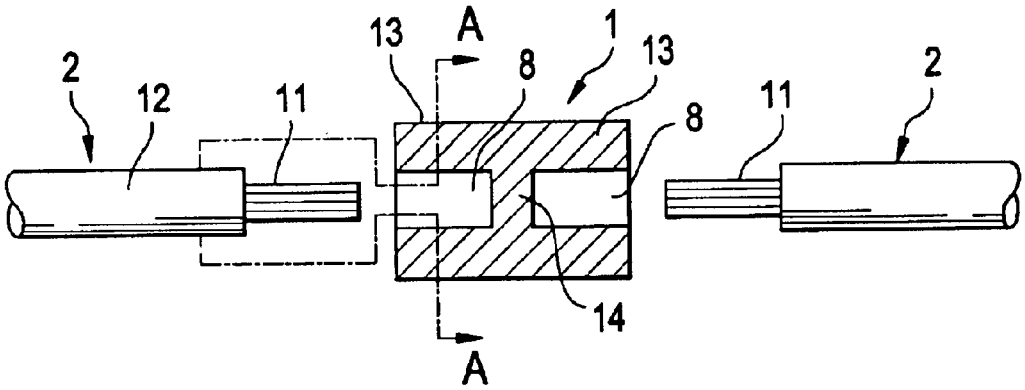
FIG. 10 is a perspective view showing the conductor and the insulating jacket being received within the tubular portion.

The gap between the bottom surface of each hole 8 and the distal end of the conductor portion 11 is almost or completely eliminated as a result of the plastic deformation of the tubular portion 13 as shown in FIG. 3A. Each conductor portion 11 is compressed hard with the uniform force over the entire periphery thereof by the tubular portion 13, and the stresses, acting on the conductor portion 11, are made uniform, and the internal stress of the conductor portion 11 is made uniform, and the conductor portion 11 is firmly intimately contacted with the tubular portion 13 because of its resiliency, so that the electrical contact is enhanced, and besides the withdrawal of the conductor portion 11 is prevented. In this embodiment, although only the conductor portion 11 is pressed, the insulating sheath 12 and the conductor portion can be pressed simultaneously by the tubular portion 13 so as to enhance the waterproof/dust prevention ability as shown in FIG. 10.

Figure 4:
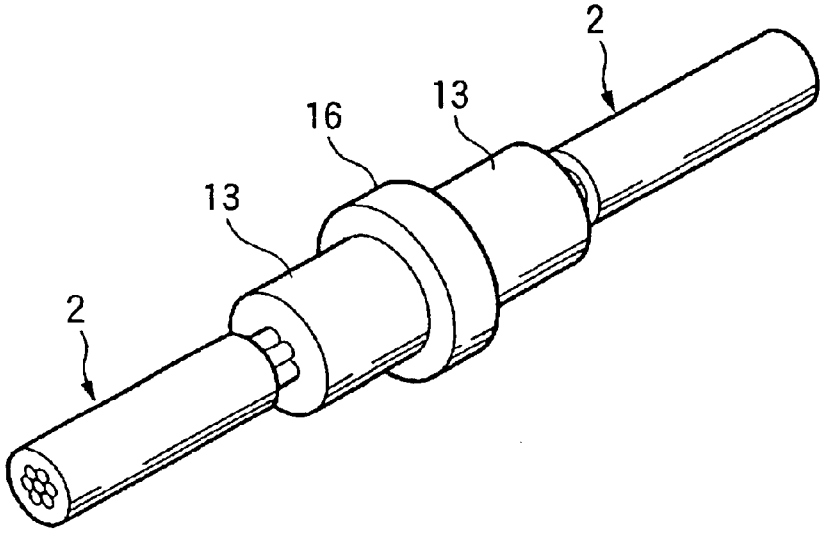
FIG. 4 is a perspective view showing the above connecting structure.

As shown in FIG. 4, each tubular portion 13 is plastically deformed into a cylindrical, completely cross-sectionally-circular shape. The outer peripheral portion of the partition wall 14 (FIG. 1) between the tubular portions 13 is not pressed, and therefore projects outwardly in an annular shape. This annular portion 16 can be used, for example, as a portion for retaining an insulating cover and an insulating housing (not shown).

In order that the annular portion 16 will not be formed, the partition wall 14 (FIG. 1) can be formed into a wall thickness equal to or smaller than that of the tubular portion 13, and can be pressed at the same time. By doing so, the two (front and rear) wires 2 and 2 can be pressed at the same time by a single pressing operation though depending on the axial length of the dies 7 (FIG. 2). The two wires 2 and 2 are disposed on a common straight line. The provision of the partition wall 14 (FIG. 1) can be omitted, thereby communicating the front and rear holes 8 and 8 (FIG. 1) with each other.

The number of the wires 2 is not limited to two, and three or more wires can be suitably used in combination, for example, in such a manner that two wires are inserted in one tubular portion 13 (FIG. 1) while one wire is inserted in the other tubular portion 13. In this case, the wire in the other tubular portion can be used as a power wire while the two wires in the one tubular portion can be used as power branching wires.

A bundle of conductor portions 11 of a plurality of wires 2 are pressed uniformly over an entire periphery thereof by one tubular portion 13, and by doing so, stresses, acting on these conductor portions 11, are made uniform, and a gap between the conductor portions 11 is eliminated, and also a gap between each conductor portion 11 and the tubular portion 13, as well as a gap between element wires of each conductor portion 11, is eliminated, so that the good electrical contact can be obtained as in the case of connecting one wire to one wire.

For using a copper alloy and an aluminum material for one joint terminal 1 and conductor portions 11 of two wires 2 and 2, shown in FIG. 1, there are three combinations of these materials. Namely, there are the case where the joint terminal 1 is made of the copper alloy, and one wire 2 is made of the copper alloy, and the other wire 2 is made of the copper alloy, the case where the joint terminal 1 is made of the aluminum material, and one wire 2 is made of the copper alloy, and the other wire 2 is made of the aluminum material, and the case where the joint terminal 1 is made of the aluminum material, and one wire 2 is made of the aluminum material, and the other wire 2 is made of the aluminum material.

During the entire-periphery pressing of the joint terminal 1 by the rotary swaging machine 10, the outer peripheral portion of the conductor portion 11 of each wire 2 bites into the inner peripheral surface of the tubular portion 13, and therefore an oxide film, formed on the aluminum material, is removed by the friction, developing at this time, so that the good conducting performance is achieved, and therefore the desired aluminum material can be used for the joint terminal and the conductor portions as in the above combinations.

Electrically-conductive plating can be applied to the inner surface of the joint terminal 1 of the aluminum material and the surface of the conductor portion 11 of the aluminum material. Instead of the plurality of element wires, a single thick copper wire or aluminum wire can be used as the conductor portion 11.

FIGS. 5 and 6 show a second embodiment of a wire connecting structure and a wire connecting method provided in accordance with a second embodiment of the present invention.

This connecting structure and connecting method are characterized in that two wires 2 and 2 are arranged parallel to each other, and conductor portions 11 are inserted into a generally tubular joint terminal (terminal) 21, and in this condition the joint terminal 21 is pressed to be compressively plastically deformed uniformly over an entire periphery thereof by the above rotary swaging machine 10 (FIG. 2).

Figure 5A:
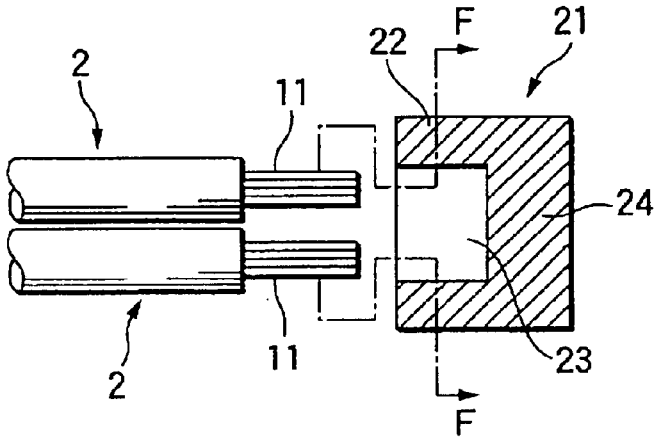
FIG. 5A is a partly (terminal) cross-sectional, plan view.
Figure 5B:
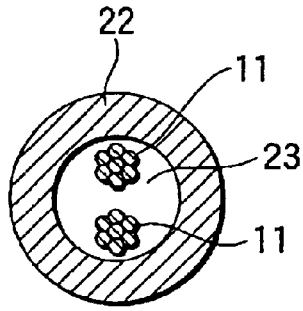
FIG. 5B is a cross-sectional view taken along the line F-F.

The joint terminal 21 is made of an electrically-conductive material, such as a copper alloy and an aluminum material, as described above for the preceding embodiment, and this joint terminal has a cap-shape in its initial condition as shown in FIGS. 5A and 5B, and includes a tubular portion 22, defined by an annular peripheral wall, and a sealing wall 24 of a circular shape which extends from the tubular portion 22, and seals or closes a bottom side of a wire-inserting hole 23 in the tubular portion 22.

The inner diameter of the hole 23 is slightly larger than the total of outer diameters of the conductor portions 11 of the two wires 2 and 2. A wall thickness of the tubular portion (peripheral wall) 22 is generally equal to a wall thickness of the sealing wall 24. The sealing wall 24 mainly serves to prevent water drops, dust and so on from intruding into the conductor portions 11 after the pressing operation. The depth of the hole 23 is equal to or larger than the length of an exposed portion of each conductor portion 11. The conductor portion 11 is composed of a plurality of element wires made of a copper alloy or an aluminum material as described above for the preceding embodiment.

In FIG. 5, the conductor portions 11 of the two wires 2 and 2 are inserted into the hole 23 in the joint terminal 21 in parallel relation to each other, and the joint terminal 21 is pressed to be compressively plastically deformed uniformly over the entire periphery thereof, for example, by the working portion of the rotary swaging machine 10 shown in FIG. 2.

Figure 6A:
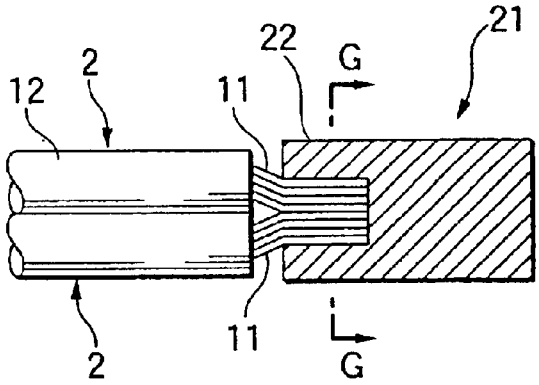
FIG. 6A is a partly-cross-sectional, plan view.
Figure 6B:
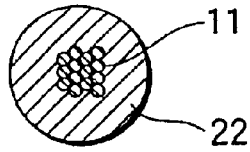
FIG. 6B is a cross-sectional view taken along the line G-G.
Figure 7:
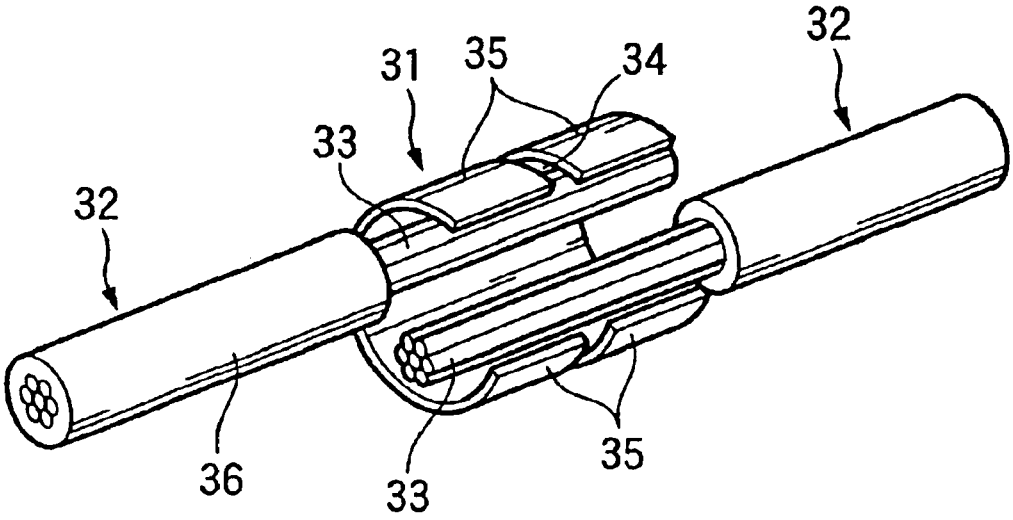
FIG.7 PRIOR ART
FIG. 7 is an exploded, perspective view showing a conventional wire connecting structure and a wire connecting method.
Figure 8:
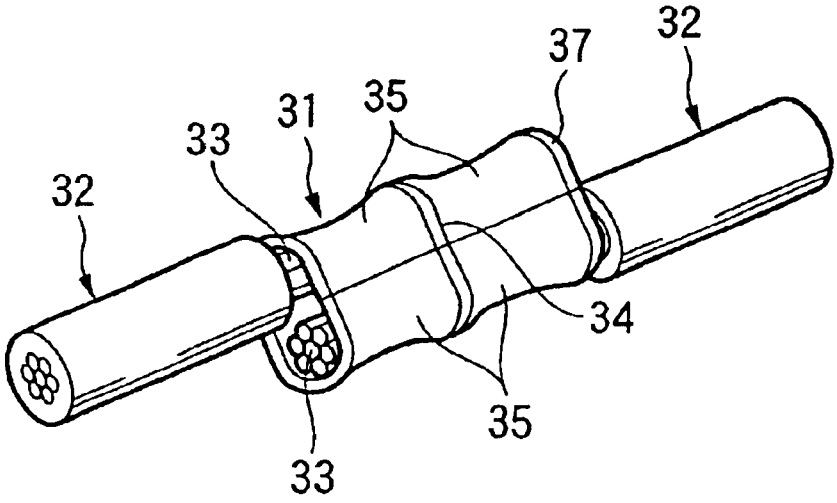
FIG.8 PRIOR ART
FIG. 8 is a perspective view showing a wire-connected condition.
Figure 9:
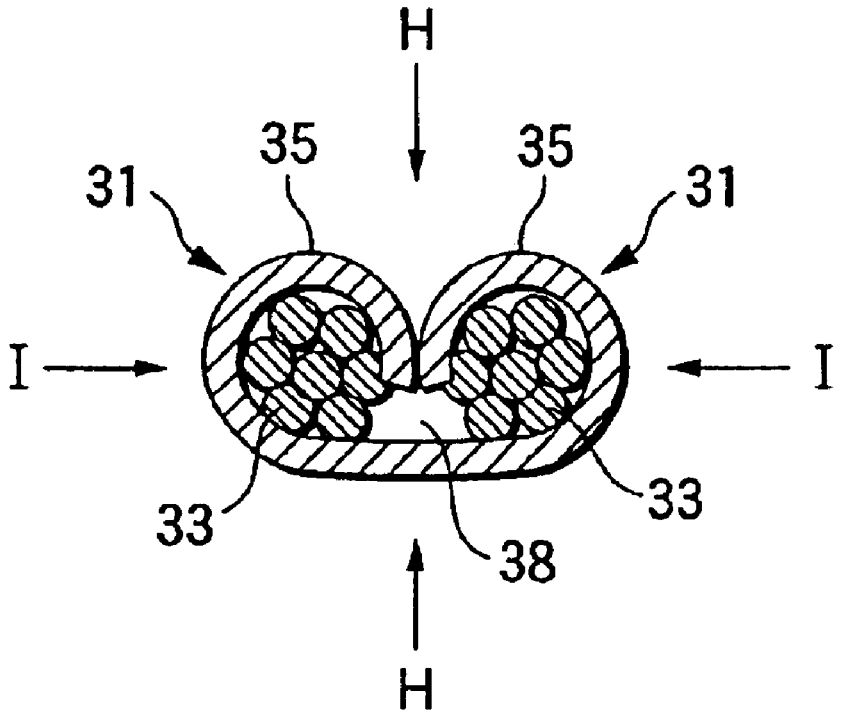
FIG.9 PRIOR ART
FIG. 9 is a cross-sectional view showing the wire-connected condition.

As a result, the joint terminal 21 is reduced in diameter over the entire length thereof as shown in FIG. 6A, and the two conductor portions 11 and 11 are pressed hard radially to be combined together as shown in FIG. 6B, so that the two conductor portions 11 and 11 are pressed uniformly over the entire periphery and generally over the entire length, and are connected together. The two conductor portions 11 and 11 are compressed into a circular cross-sectional shape, and are held in intimate contact with the inner peripheral surface of the tubular portion 22, with no gap formed therebetween, and also the element wires, each having an initial circular cross-sectional shape, are deformed to assume a generally honeycomb-like cross-sectional shape, and are intimately contacted with one another, with no gap formed therebetween. As a result, the deposition of an oxide film with the lapse of time is prevented. And besides, those element wires of the conductor portions 11, disposed at the outer peripheral portion, bite into the inner peripheral surface of the tubular portion 22, and therefore are held in firm, intimate contact therewith, and at the same time an oxide film, initially formed on the surfaces of the joint terminal 21 and conductor portions 11, made, for example, of an aluminum material, is removed by the friction.

The conductor portions 11 of the two wires 2 and 2 are directly intimately contacted with each other, with no gap formed therebetween, and therefore the conducting resistance of the joint terminal 21 can be totally ignored as compared with the first embodiment, and the conducting performance is further enhanced. And besides, the two wires 2 can be positively joined together by one swaging operation, and therefore the operation is easy, and the efficiency of the production is high. In addition, the shape of the joint terminal 21 is simplified, and the cost is reduced.

The tubular portion 22 is extended in the axial direction, and the sealing wall 24, together with the tubular portion 22, is reduced in diameter, and the joint terminal is deformed into a generally cylindrical shape having the uniform outer diameter over the entire length thereof. Therefore, the shape after the deformation is simplified, and an insulating cap (not shown) can be easily attached. Insulating sheaths 12 of the two wires 2 and 2 are disposed in parallel, contiguous relation to each other. One of the first embodiment and the second embodiment can be selected in accordance with the direction of arrangement of the wires 2.

The conductor portions 11 of the two wires 2 and 2 are held in intimate contact with each other, with no gap formed therebetween, and the two conductor portions 11 are held in intimate contact with the joint terminal 21, with no gap formed therebetween, and therefore the conducting performance is enhanced, and besides the heating is prevented as described above for the first embodiment.

In the embodiment of FIG. 5, the number of wires 2 can be three or more. In any case, the plurality of conductor portions 11 are integrally joined together by swaging, with no gap formed therebetween, and the good conducting performance can be obtained. One wire can be used as a power wire while the other one or two wires can be used as branching wires.

In the embodiment of FIG. 5, the provision of the sealing wall 24 of the joint terminal 21 can be omitted, so that the hole 23 extends through the joint terminal, and the wires 2 can be inserted into the hole 23 respectively from the front and rear ends thereof, so that the conductor portions 11 of the two wires 2 overlap each other, and in this condition the tubular portion 22 can be pressed over the entire periphery thereof.

In the embodiment of FIG. 1, three or more (for example, three or four) tubular portions 13 can be formed on the joint terminal 1, and the conductor portion 11 of the wire 2 within each tubular portion 13 can be pressed uniformly over the entire periphery thereof.

As described above, according to the invention, the conductor portion of each wire is compressively pressed with the uniform stress over the entire periphery, and therefore a gap will not be formed between each conductor portion and the tubular portion of the terminal, and also a gap will not be formed in each conductor portion, and each conductor portion is held in intimate contact with the inner surface of the tubular portion, with no gap formed therebetween, and also the element wires, forming each conduction portion, are intimately contacted with one another, with no gap formed therebetween, and the conductor portions are positively connected together with a small conducting resistance. Therefore, there liability of the wire joint connection is enhanced.

Even in the case where an aluminum material is used for the conductor portions of the wires and the terminal, a gap will not develop between the terminal and each conductor portion, and also a gap will not develop between the element wires of each conductor portion, and therefore the formation of an oxide film is prevented, and besides those element wires of each conductor portion, disposed at the outer peripheral portion thereof, bite into the inner surface of the tubular portion, so that an oxide film, initially formed on the aluminum material, is removed, and therefore the positive electrical contact is achieved, and the reliability of the joint connection is enhanced.

The conductor portions of the wires are connected respectively to the front and rear sides of the terminal, and the wires extending therefrom in the opposite directions, respectively, and the conductor portions of at least two wires are connected together through the terminal. Particularly, each conductor portion is held in intimate contact with the inner 5 surface of the tubular portion, with no gap formed therebetween, and also the element wires of each conductor portions are intimately contacted with one another, with no gap formed therebetween, and therefore the conductor portions are positively joint-connected together with a very small conducting resistance with no conducting loss even through the terminal. And besides, even in the case where the conductor portions, which are to be inserted respectively into the pair of tubular portions, are different in diameter from each other, the tubular portions can have the same inner and outer diameters, and this situation can be dealt with by changing the amount of compressive deformation of the tubular portions, and therefore the shape of the terminal can be simplified, and its cost can be reduced.

At least two conductor portions are compressively pressed with the uniform stress over the entire periphery in parallel, contiguous relation to each other, and are connected together, and each conductor portion is held in intimate contact with the inner surface of the tubular portion, with no gap formed therebetween, and also the element wires of each conductor portion are intimately contacted with one another, with no gap formed therebetween, and therefore the conducting performance is enhanced, and the reliability of the joint connection is enhanced. The wires extend in the same direction, and can meet the wiring direction different from that of the invention of claim 2. And besides, there is provided the single tubular portion, and therefore only one pressing operation is needed, and the operation is easy.

The tubular portion can be positively and easily pressed compressively while pounded over the entire periphery thereof by the rotary swaging machine, and the wire joint connecting operation can be effected easily and positively.

What is claimed is:

1. A wire connecting structure comprising:

at least two wires including conductor portions and insulating jackets; and a terminal including at least one tubular portion in which a blind hole is provided, wherein the conductor portions are inserted into the blind hole of the at least one tubular portion, so that ends of the conductor portions are disposed within the at least one tubular portion, wherein the ends of the conductor portions are electrically connected to a bottom of the blind hole, wherein the at least one tubular portion is plastically deformed uniformly in a radial inward direction so that the conductor portions are pressed uniformly over an entire periphery, and wherein the insulating jackets of the at least two wires are interposed between an electrically conductive portion of the at least one tubular portion and the conductor portions.

2. The wire connecting structure according to claim 1, wherein the at least one tubular portion is formed at a first side of the terminal and another tubular portion is formed at an opposite side of the terminal, and the conductor portions of the at least two wires are pressed uniformly over the entire periphery within each of the tubular portions.

3. The wire connecting structure according to claim 1, wherein the terminal has only one tubular portion, and the conductor portions of the at least two wires are pressed uniformly over the entire periphery within the one tubular portion in such a manner that the conductor portions are combined together.

4. A method of connecting a wire comprising the steps of:

inserting conductor portions of at least two wires into a blind hole of at least one tubular portion of a terminal, so that ends of the conductor portions are disposed within the at least one tubular portion, so that the ends of the conductor portions are electrically connected to a bottom of the blind hole, and so that insulating jackets of the at least two wires are interposed between an electrically conductive portion of the at least one tubular portion and the conductor portions of the at least two wires; and pressing uniformly the tubular portion over an entire periphery thereof so that the tubular portion is plastically deformed uniformly in a radial inward direction.

5. The method according to claim 4, wherein the pressing of the tubular portion is effected by a rotary swaging machine.

* * * * *